US006966670B1

(12) United States Patent
Lin

(10) Patent No.: US 6,966,670 B1
(45) Date of Patent: Nov. 22, 2005

(54) GANG LAMP STRUCTURE

(76) Inventor: Mei-Lu Lin, P.O. Box 697, Feng-Yuan City, Taichung Hsien (TW) 420

( * ) Notice: Subject to any disclaimer, the term of this patent is extended or adjusted under 35 U.S.C. 154(b) by 73 days.

(21) Appl. No.: 10/724,142

(22) Filed: Dec. 1, 2003

(51) Int. Cl.[7] ..... F21S 19/00
(52) U.S. Cl. ..... 362/227; 362/252; 362/806; 362/391
(58) Field of Search ..... 362/227, 226, 362/249, 252, 391, 806; 439/699.2

(56) References Cited

U.S. PATENT DOCUMENTS 4,118,764 A * 10/1978 Bleiweiss et al. ..... 362/369
5,416,678 A * 5/1995 Schabowski ..... 362/249
5,913,597 A * 6/1999 Lin ..... 362/226
5,938,314 A * 8/1999 Lin ..... 362/249

* cited by examiner

*Primary Examiner*—Ali Alavi

(57) ABSTRACT

An improved gang lamp structure includes a first socket and a second socket alternately integrated with one another with the first socket positioned slightly higher than the second socket and each of the sockets has a first and second insertion grooves, wherein the first socket has a rectangular opening in an upper periphery abutting the upper rims of the sockets, the second socket has a pair of hooks facing a stop plate respectively formed on opposing upper peripheries to define a gap therebetween. A bent step shaped copper plate strides on the bottom of the opening having an upper contact surface engaged within the second insertion groove of the first socket and a lower contact surface engaged with the first insertion groove of the second socket. A pair of electric wires each has a contact plate on the top respectively engaged with the first insertion groove of the first socket and the second insertion groove of the second socket. A first lamp has a rectangular protrusion on a periphery of the base inserted into the first socket and a second lamp has a pair of L-shaped projections on opposing peripheries of the base inserted into the second socket. The L-shaped projections block the gaps after the electric wire engaged into the hooks.

6 Claims, 7 Drawing Sheets

GANG LAMP STRUCTURE

BACKGROUND OF THE INVENTION

The present invention relates to the Christmas lights and/or the networked lamps and more particularly to an improved gang lamp structure in which the sockets of the lamp are juxtaposedly and higher and lowered intergraded with each other in order to give the sense of stepped stereometry and to make varied forms.

Conventional Christmas lights are separately connected into a string by electric wires. Although, a juxtaposedly arranged twin socket is produced. But each socket requires a pair of electric wires. If combines a plurality of such sockets together, it requires a lot of sets of electric wire that is more complex than a conventional string of Christmas lights and could not make varied forms except suspending from a Christmas tree to emit blinking light. My U.S. Pat. Nos. 5,938,314 and 5,913,597 provide some improvement. But it still have the disadvantage that the juxtaposed sockets could not appear prominent sense of stepped stereometry and variety.

SUMMARY OF THE PRESENT INVENTION

The present invention has a main object to provide an improved gang lamp structure in which the juxtaposed sockets are of different uneven structure to appear the sense of stepped stereometry and to combine the a plurality of the juxtaposed sockets to make varied configurations.

Accordingly, the improved gang lamp structure comprises at least a first and a second sockets unevenly integrated with one another with the second socket slightly higher than the first socket. The first socket has a pair of hooks symmetrically formed on opposing the upper outer peripheries and each of the hooks faces a stop plate so as to define a gap therebetween. The second socket has a rectangular opening in an upper periphery toward the upper rim of the first socket for disposing a bent step shaped copper plate which has a first contact surface on the top inserted into the second socket and a second contact surface on the lower portion inserted into the first socket. A pair of first and second lamps respectively engage into the first and second socket each having a base, a bulb and a pair of lead-in wires attached to the bottom of the bases, wherein the base of the first lamp has a pair of projections symmetrically formed on the opposing outer peripheries to respectively engage within the gaps of the first socket and the base of the second lamp has a rectangular protrusion on an outer periphery to engage within the rectangular opening of the second socket. A pair of electric wires each has a contact plate at the top respectively inserted into the bottom of the sockets with the wires respectively engaged within the hooks of the first socket. Since the lead-in wires of the lamps respectively contacted with the contact surfaces and the contact plates, the electrical circuits are established.

The present invention will become more fully understood by reference to the following detailed description thereof when read in conjunction with the attached drawings.

DETAILED DESCRIPTION OF THE PREFERRED EMBODIMENT

Figure 1:
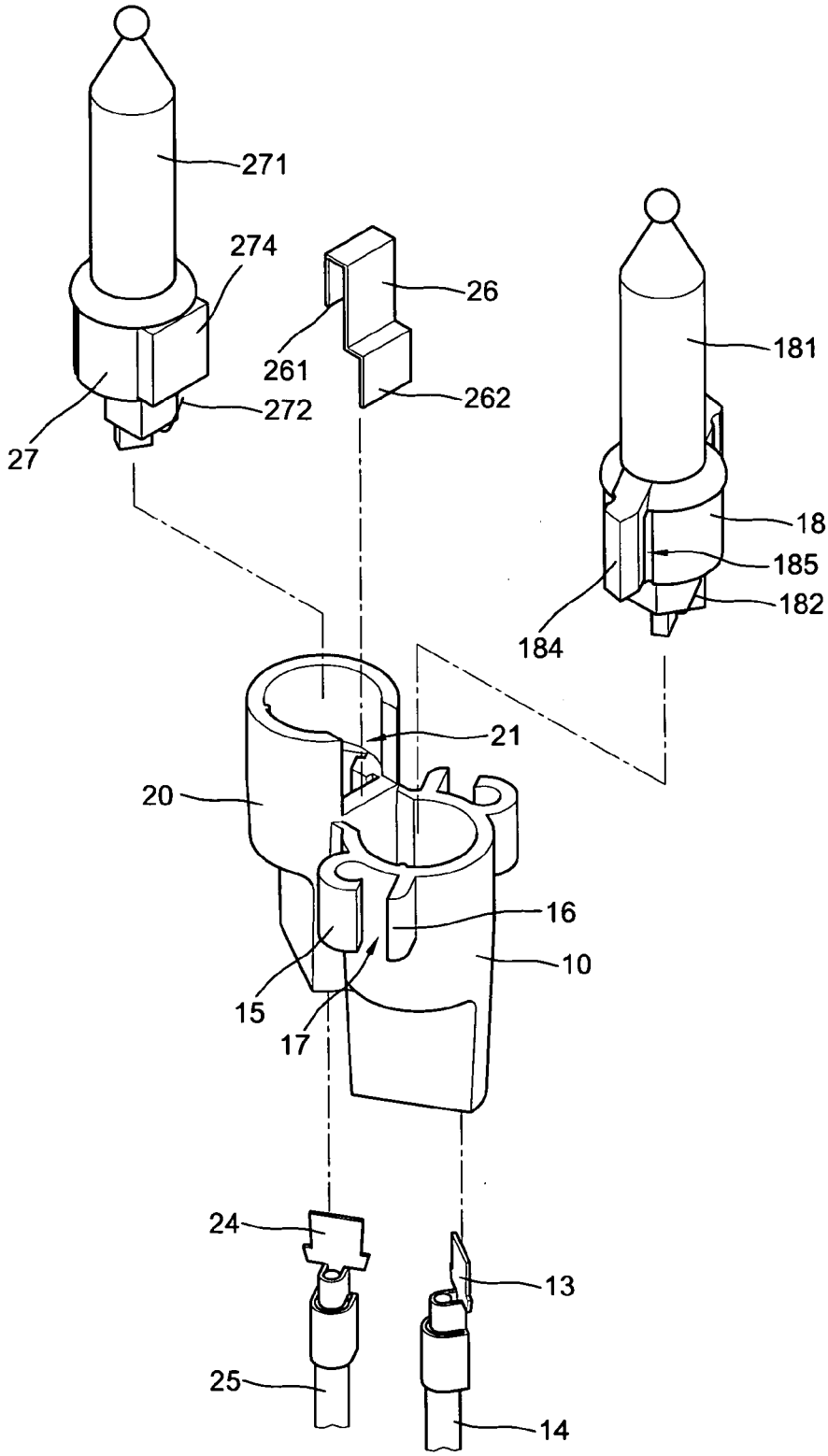
FIG. 1 is an exploded perspective view of a gang lamp of the first embodiment according to the present invention.
Figure 2:
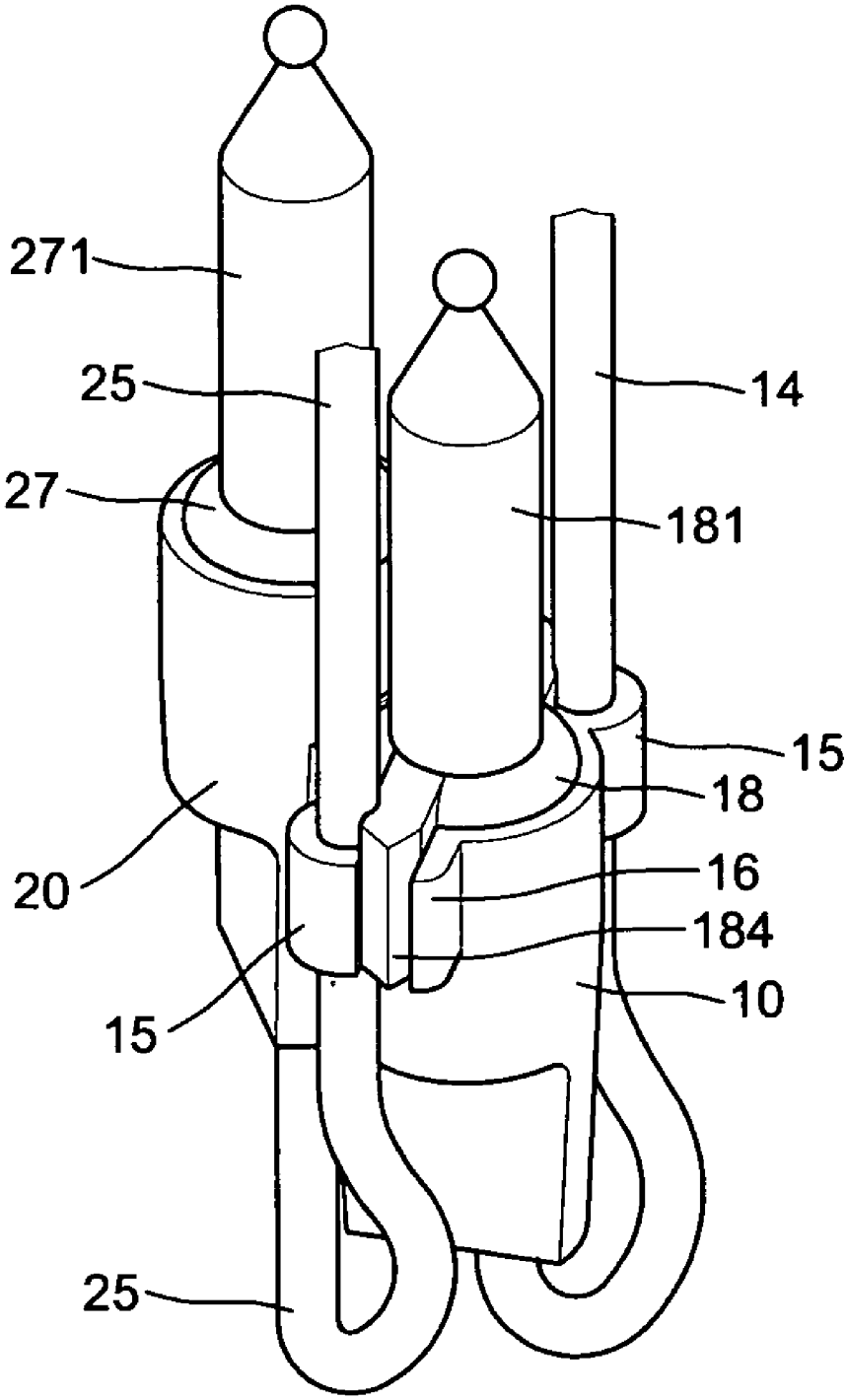
FIG. 2 is a perspective view to show the assembly of FIG. 1.
Figure 3:
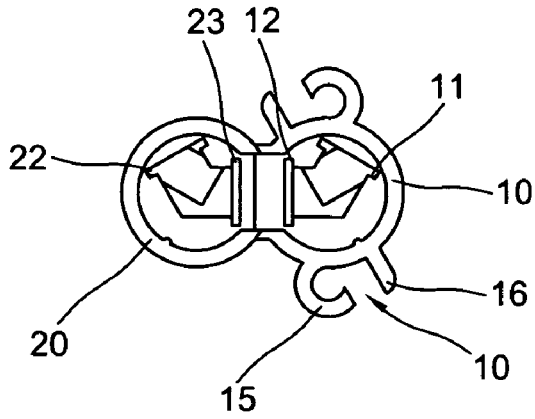
FIG. 3 is a top plane view to show the sockets of the first embodiment.
Figure 4:
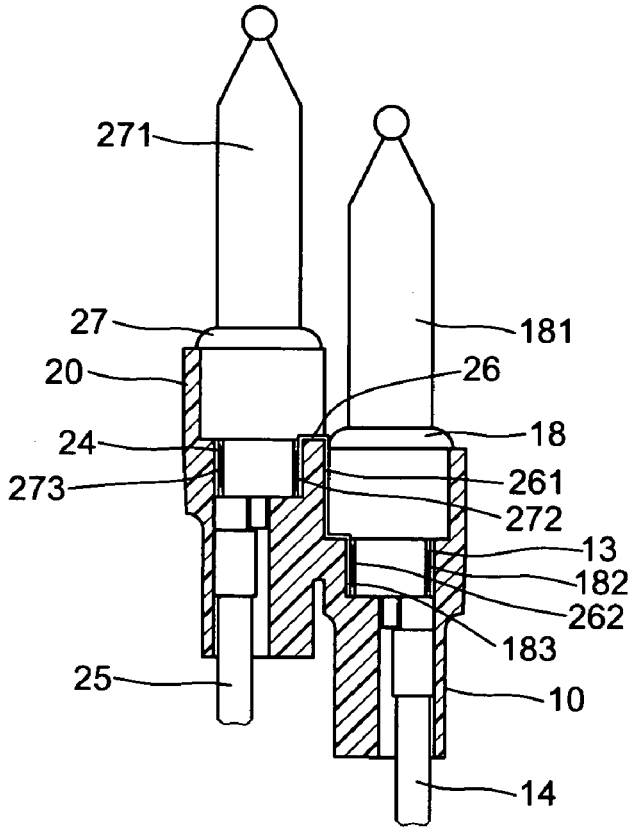
FIG. 4 is a sectional view of FIG. 2.

With reference to FIGS. 1 to 4 of the drawings, a first embodiment of the gang lamp structure according to the present invention is provided. This gang lamp structure comprises two sockets 10 and 20 alternately and juxtaposedly integrated with one another, wherein the socket 20 is positioned slightly higher than the socket 10. The socket 10 has a pair of hooks 15 in cooperation with a pair of stop plate 16 symmetrically formed on the opposing upper peripheries to define a gap 17 therebetween, a pair of insertion grooves 11 and 12 spacedly form in an inner wall. The socket 20 has a rectangular opening 21 abutting the upper rim and the socket has a pair insertion grooves 22 and 23 spacedly formed in an inner wall. A bent step shaped copper plate 26 strides over the bottom of the opening 21 having an upper contact surface 261 inserted into the insertion groove 23 of the socket 20 and a lower contact surface 262 inserted into the insertion groove 12 of the socket 10 (as shown in FIG. 3). A pair of electric wires 14 and 25 each has a contact plate 13 and 24 on the top respectively inserted into the bottom of the sockets 10 and 20 with the contact plate 13 engaged into the insertion groove 11 of the socket 10 and the contact plate 24 engaged within the insertion groove 22 of the socket 20. A pair of lamps each has a base 18 and 27, a bulb 181 and 271 in the top and a pair of lead-in wire 182, 183 and 272, 273 separately attached to the bottom of the bases 18 and 27, wherein the base 18 has a pair of L-shaped projections 184 symmetrically formed on the opposing peripheries each including a slit 185 therebetween, the base 20 has a rectangular protrusion 274 on an outer periphery, when the pair of electric wires 14 and 25 are engaged with hooks 15, immediately inserts the base 18 in the upper rim of the socket 10 so that the pair of L-shaped projections 184 will block the gaps 17 to prevent the wires 14 and 25 from loosening off. Then inset the base 27 into the upper rim of the socket 20, the rectangular protrusion 274 just blocks the rectangular opening 21 and presses the top of the bent step shaped copper plate 26. Due to the frictional engagement of the bases 18 and 27 within the sockets 10 and 20, the lead-in wires 182, 183 and 272, 273 are automatically contacted with the contact plates 13 and 24 and the contact surfaces 262 and 261 so as to form an electric circuit inside the sockets 10 and 20 to light the bulbs 181 and 271 which appear a stereo result.

Figure 5:
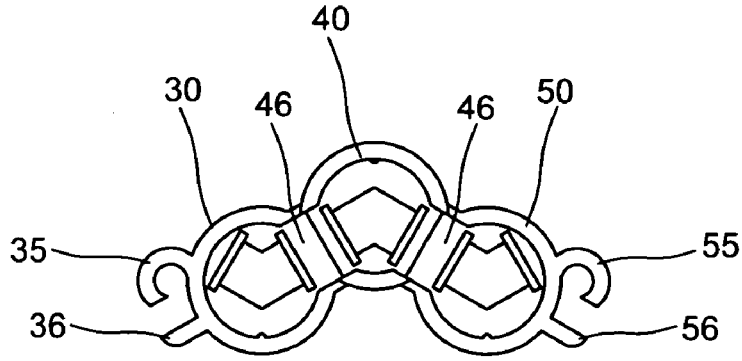
FIG. 5 is a top view to show the sockets of the second embodiment according to the present invention.
Figure 6:
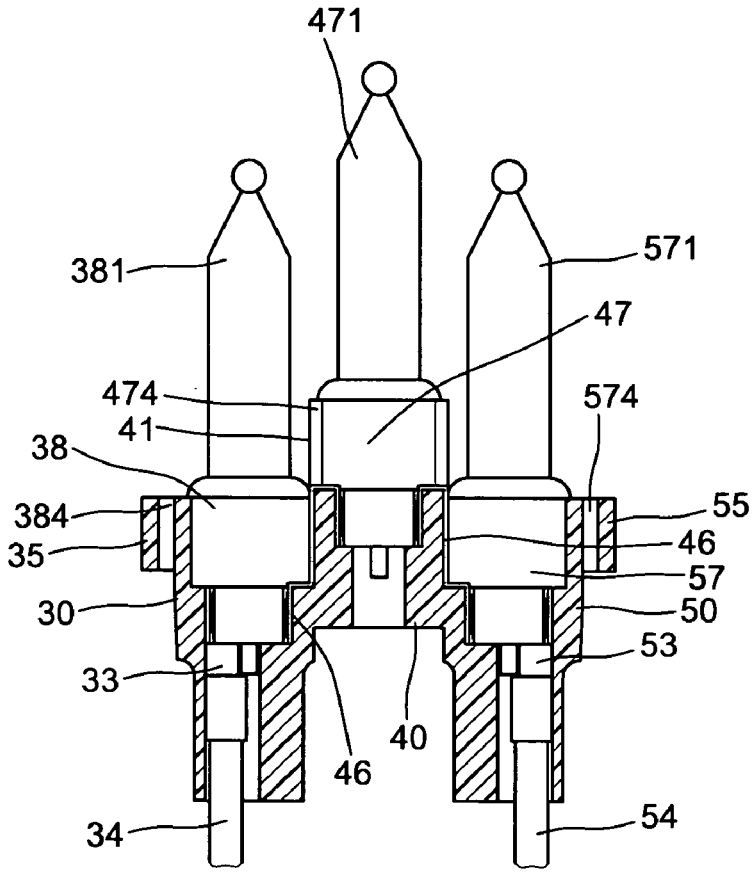
FIG. 6 is a sectional view to show the assembly of FIG. 5.

Referring to FIGS. 5 and 6, a second embodiment of the gang lamp structure of the present invention is provided. This gang lamp structure comprises three sockets 30, 40 and 50 alternately and juxtaposedly integrated with each other with the socket 40 positioned slightly outward and higher than the other two sockets 30 and 50 so as to form an arcuate configuration. The socket 40 has a pair of rectangular openings 41 in the opposing peripheries abutting the upper rims of itself and the sockets 30 and 50. The sockets 30 and 50 each has a hook 35 and 55 in cooperation with a stop plate 36 and 56 on an outer upper periphery with a gap defined therebetween. The inside structure of the socket 40 is similar to that of the socket 20 and the sockets 30 and 50 are similar to that the socket 10 of the first embodiment. A pair of bent step shaped copper plates 46 symmetrically stride over the bottom of the two rectangular openings 41 with their upper contact surfaces simultaneously inserted into the socket 40 and their lower contact surfaces respectively inserted into the sockets 30 and 50. A pair of electric wires 34 and 54 each has a contact plate 33 and 53 respectively inserted into the bottom of the sockets 30 and 50. The rest wires 34 and 54 are respectively engage within the hooks 35 and 55. The lamp base 47 has a bulb 471 in the top and a pair of rectangular protrusions 474 respectively engaged within the rectangular openings 41 of the socket 40 and pressed the top of the bent step shaped contact plates 46 and having a pair of lead-in wires attached on the bottom respectively engaged with the upper contact surfaces of the bent step shaped contact plates 46. A pair of identical lamp bases 38 and 57 frictionally engage within the upper rim of the sockets 30 and 50 and each has a bulb 381 and 571 in the top, a pair of lead-in wires attached to the bottom and respectively engaged with the lower contact surfaces of the bent step shaped contact plate 40 and the contact plates 33 and 53 inside the sockets 30 and 50. So that an electric circuit is established inside the three sockets 30, 40 and 50 to light the uneven bulbs 381, 471 and 571.

Figure 7:
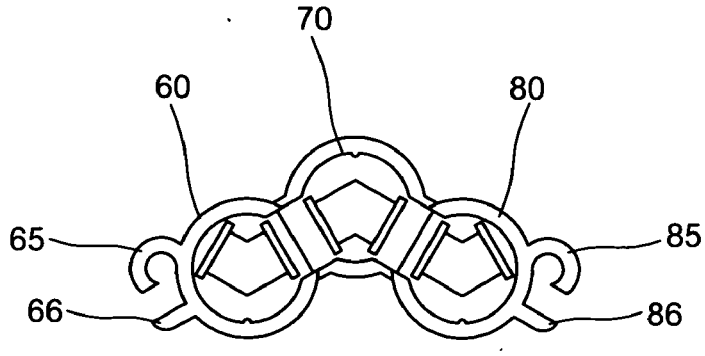
FIG. 7 is a top view to show the sockets of the third embodiment according to the present invention.
Figure 8:
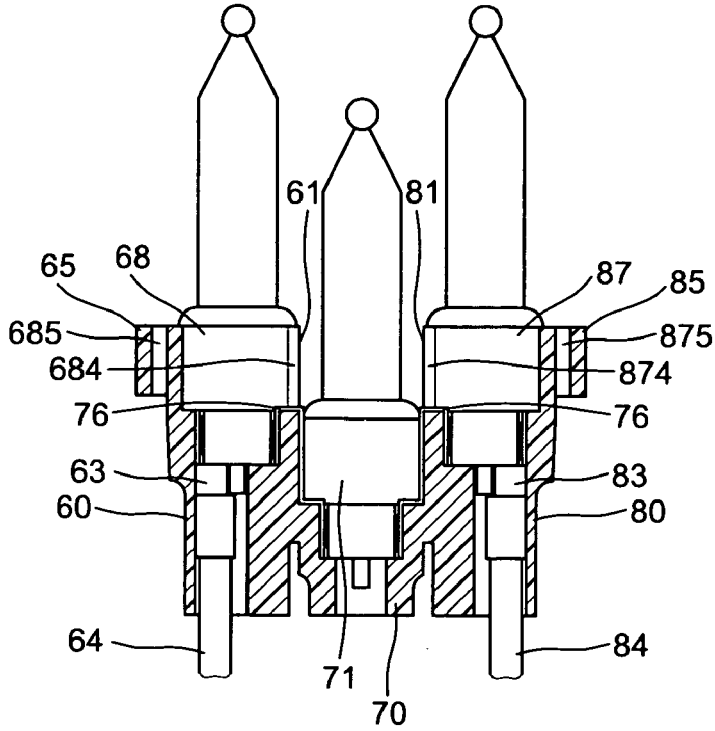
FIG. 8 is a sectional view to show the assembly of FIG. 7.

FIGS. 7 and 8 show a third embodiment of the gang lamp structure of the present invention. This embodiment comprises also three sockets 60, 70 and 80 juxtaposedly integrated with each other with the socket 70 positioned slightly outward and lowered than the other two socket 60 and 80 so as to form an arcuate configuration. The sockets 60, 70 and 80 each has a pair of insertion grooves spacedly formed in their inner walls, wherein the sockets 60 and 80 each has a rectangular opening 61 and 81 in their inner peripheries abutting the upper rims of the three socket 60, 70 and 80 and a hook 65 and 85 in cooperation with a stop plate 66 and 86 on each of their opposing outer upper peripheries to define a gap therebetween. A pair of electric wires 64 and 84 engage within the hooks 65 and 85 respectively and each has a contact plate 63 and 83 inserted into the bottom of the sockets 60 and 80 and respectively engaged within one of the insertion grooves in the socket 60 and 80, a pair of bent step shaped copper plates 76 respectively stride on the bottom of the openings 61 and 81 and each has an upper contact surface respectively engaged within the other insertion grooves of the sockets 60 and 80 and a lower contact surface respectively engaged with the pair of insertion grooves of the socket 70, a lamp 71 including a bulb and a pair of lead-in wires attached on the base frictionally engages into the upper rim of the socket 70 with the lead-in wires engaged with the lower contact surfaces of the bent step shaped copper plates 76. A pair of identical lamps 68 and 87 respectively and frictionally insert into the upper rim of the sockets 60 and 80 and each has a base, a bulb and a pair of pair lead-in wires attached to the bottom of the base and respectively engaged with the contact plates 63 and 83 and the upper contact surfaces of the bent step shaped copper plates 76 and each has a rectangular protrusion 684 and 874 on the inner periphery of the base engaged within the rectangular openings 61 and 81 and pressed the top of the bent step shaped copper plates 76 and a L-shaped projection on the outer periphery of the base respectively blocked gap of the sockets 60 and 80.

Figure 9:
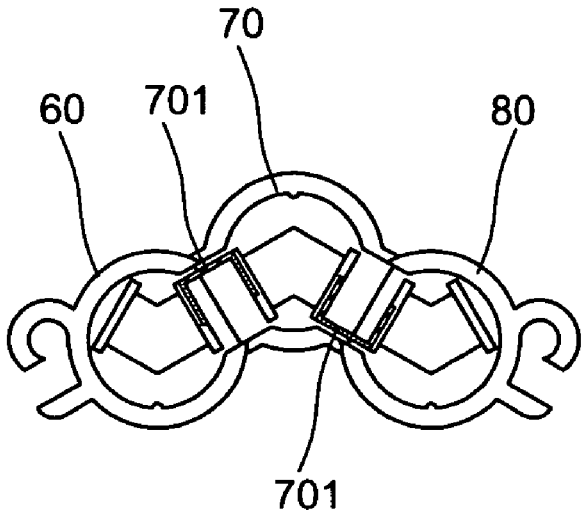
FIG. 9 is a top view to show the copper plate inside the sockets.

FIG. 9 shows an alternative bent step shaped copper plate 701 which the horizontal section may be of roughly U-shaped and which suits to use in the first and third embodiments.

Figure 10:
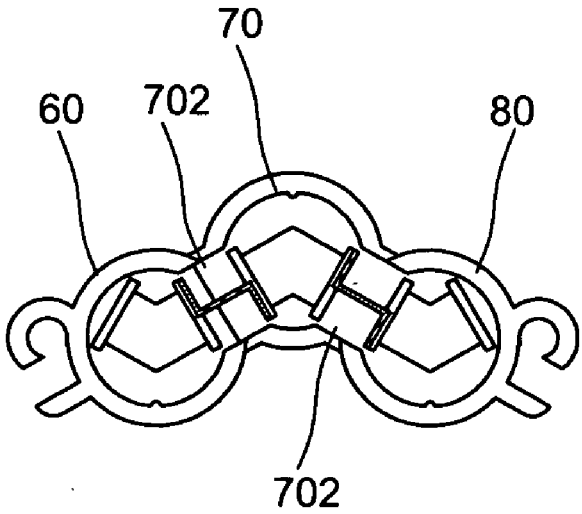
FIG. 10 is a top view to show another type of copper plate in the sockets.

FIG. 10 shows another alternative bent step shaped copper plate 702 which the horizontal section may be of a roughly N-shaped and which suits to use between the sockets 60 and 70 of the third embodiment to act as a bridge to connect the electricity.

Figure 11:
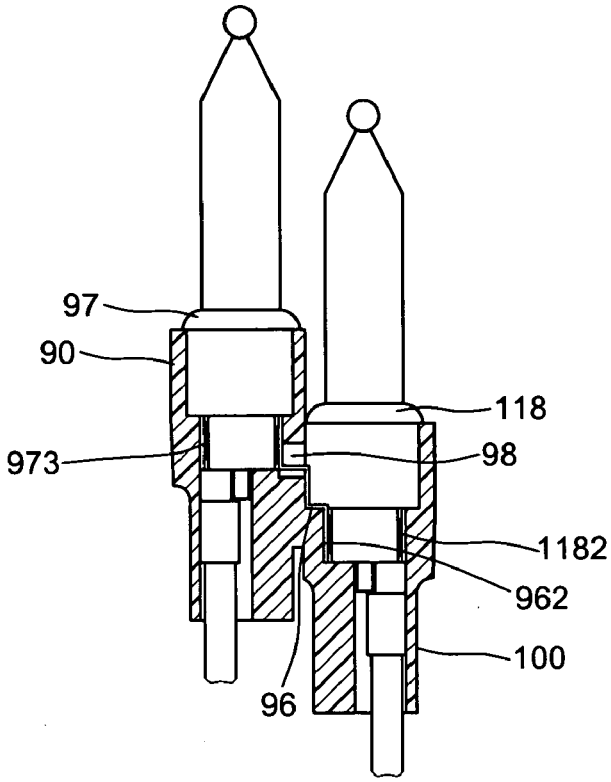
FIG. 11 is a sectional view of a fourth embodiment of the gang lamp according to the present invention.
Figure 12:
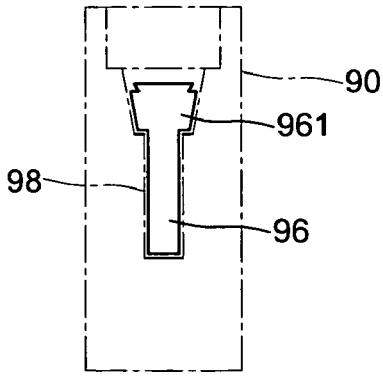
FIG. 12 is a plane view to show a copper plate inlaid into a insertion groove of FIG. 11.

Referring to FIGS. 11 and 12, a fourth embodiment of the gang lamp structure of the present invention is provided. This embodiment is mostly similar to the first embodiment as shown in FIGS. 1 to 4 and the above discussed instances are mostly applicable. The difference is that the opening 21, the hooks 15 and the stop plates 16 on the sockets are all omitted and the rectangular protrusion 274 and the L-shaped projections 184 are removed. Instead of is a through hole 98 punched between the sockets 90 and 100, a bent step shaped copper plate 96 inserted through the through hole 98 having an upward upper contact surface 961 engaged within an insertion groove (not shown) in an inner wall of the socket 90 and a downward lower contact surface 962 engaged within an insertion groove (not shown) in an inner wall of the socket 100. A pair of lamps 97 and 118 respectively and frictionally engaged into the upper rim of the sockets 90 and 100 with the lead-in wires 973 and 1182 respectively engaged with the upper contact surface 961 and lower contact surface 962 and the contact plates of the electric wires. This embodiment has an advantage that the bent step shaped copper plate 96 is hiddened in and not exposed to the outside of the sockets 90 and 100.

The above embodiments of the gang lamp structure can be made a string or a networked Christmas lights in varied shapes.

Note that the specification relating to the above embodiments should be construed as an exemplary rather than as a limitative of the present invention, with many variations and modifications being readily attainable by a person of average skill in the art without departing from the spirit or scope thereof as defined by the appended claims and their legal equivalents.

I claim:

1. An improved gang lamp structure comprising:

a first and second sockets alternately and juxtaposedly integrated with one another and each having an upper rim, a bottom hole and a pair of first and second insertion grooves in opposing inner walls, wherein the first socket is positioned slightly higher than the second socket and having a rectangular opening in an upper periphery abutting the upper rims of said first and second sockets, the second socket having a pair of hooks facing a pair of stop plates respectively formed on opposing upper peripheries each to define a gap therebetween, a bent step shaped copper plate striding on bottom of said opening including an upper contact surface engaged within the second insertion groove of said first socket and a lower contact surface engaged within the first insertion groove of said second socket, a pair of electric wires respectively disposed in said hooks each having a contact plate respectively inserted into the bottom holes of said first and second sockets and engaged within the first insertion groove of said first socket and the second insertion groove of said second socket;

a first lamp having a base and a bulb on top of the base frictionally engaged within the upper rim of said first socket said lamp having a pair of lead-in wires separately attached on the base and respectively engaged with contact plate of the first electric wire and the upper contact surface of the bent step shaped copper plate and a rectangular protrusion on an outer periphery of the base engaged within said rectangular opening of said first socket and pressed on top of said bent step shaped copper plate;

a second lamp having a base, a bulb on top of the base frictionally engaged within the upper rim of said second socket, said lamp having a pair of lead-in wires respectively engaged with the lower contact surface of the bent step shaped copper plate and the contact plate of said second electric wire and a pair of L-shaped projections symmetrically formed on opposing peripheries of the base blocking the gaps of the second socket.

2. An improved gang lamp structure comprising:

a first, a second and a third sockets alternately and juxtaposedly integrated with each other and each having a pair of first and second insertion grooves in opposing inner walls, a upper rim and a lower hole, wherein the second socket is positioned a slightly outward and higher than the first and the third socket and having a pair of rectangular openings in opposing upper peripheries abutting the upper rim of the sockets, the first and the third sockets each having a hook facing a stop plate formed on an outer upper periphery to define a gap therebetween, a pair of first and second bent step shaped copper plates symmetrically and respectively striding on bottom of said rectangular openings each having an upper contact surface respectively engaged within the first and the second insertion grooves of said second socket and a lower contact surface respectively engaged within the second insertion groove of said first socket and the first insertion groove of said third socket, a pair of first and second electric wire respectively disposed within the hooks of said first and third sockets and each having a contact plate on top respectively inserted into the bottom holes of said first and third socket and engaged with the first insertion groove of said first socket and the second insert ion groove of said third socket;

a middle lamp having a base, a bulb on top of the base, a pair of lead-in wires separately attached on bottom of said base and a pair of rectangular protrusions on opposing peripheries of the base, when said lamp being frictionally engage with the upper rim of said second socket, said lead-in wires will be respectively engaged with the upper contact surfaces of said bent step shaped copper plates and said rectangular protrusions will be engaged with said rectangular openings of said second socket and pressed top of said bent step shaped copper plates;

a pair of side lamps each having a base, a bulb on top of the base, a pair of lead-in wires attach on bottom of said base and a L-shaped projection on an outer periphery, when frictionally and respectively engage the side lamps into the upper rims of said first and third sockets, the lead-in wires will be respectively engage with the contact plate of said first electric wire and the lower contact surface of said first bent step shaped copper plate in said first socket and the contact surface of said second bent step shaped copper plate and the contact plate of said second electric wire in said third socket and their L-shaped projections will be blocked the gaps of said first and third socket.

3. An improved gang lamp structure comprising:

a first, a second and a third sockets alternately and juxtaposedly integrated with each other and each having a first and a second insertion grooves spacedly formed in opposing inner walls, an upper rim and a bottom hole, wherein the second socket is positioned slightly outward and lowered than the first and the second socket, said first and second socket each having a rectangular opening in upper inner periphery and a hook facing a stop plate on upper outer periphery to define a gap therebetween, a pair of bent step shaped copper plates symmetrically striding on bottom of said rectangular openings each including an upper contact surface respectively engaged with the second insertion groove of said first socket and the first insertion groove of said third socket, and a lower contact surface respectively engaged with the first and second insertion grooves of said second socket a pair of first and second electric wires respectively disposed within the hooks of said first and second sockets each having a contact plate on top inserted into the bottom hole of said first and second sockets and respectively engaged with the first insertion groove of said first socket and the second insertion groove of said third socket;

a middle lamp having a base, a bulb on top of the base and a pair of lead-in wire attached separately to bottom of the base which is frictionally engaged within the upper rim of said second socket with the lead-in wires respectively engaged with the lower contact surfaces of said bent step shaped copper plates;

a pair of side lamps each having a base, a bulb on top of the base, a pair of lead-in wire separately attached to bottom of the base, a rectangular protrusion on inner periphery of the base and a L-shaped projection on outer periphery of the base, when the side lamps respect ively and frictionally engage within the upper rim of said first and third sockets, the lead-in wires respectively engage with the contact plate of said first electric wire and the upper contact surface in said first socket and upper contact surface and the contact plate of said second electric wire in said third socket.

4. The gang lamp structure as recited in claim 1, wherein said bent step shaped copper plate may appear a U-shaped horizontal section.

5. The gang lamp structure as recited in claim 3, wherein said bent step shaped copper plate may appear a N-shaped horizontal section.

6. An improved gang lamp structure comprising:

a first and a second sockets alternately integrated with one another with the first socket positioned slightly higher than the second socket and each of said sockets having first insertion groove and a second insertion groove spacedly formed in opposing inner walls, an upper rim, a bottom hole and a through hole punched between said sockets for inserting a bent step shaped copper plate which has an upward upper contact surface engaged within the second insertion groove of said first socket and a downward lower contact surface engaged within the first insertion groove of said second socket, a pair of electric wires each having a contact plate inserted into the bottom hole of said first and second sockets and respectively engaged with the first insertion groove of said first socket and the second insertion groove of said second socket, a pair of lamps each having a base, a bulb on top of the base and a pair lead-in wires separately attached to bottom of the base, when the lamps respectively and frictionally engage into the upper rim of said first and second sockets, their lead-in wire automatically engaged with the contact plates and the upper and lower contact surfaces of said bent step shaped copper plate.

* * * * *